US006334346B1

(12) United States Patent
Wang

(10) Patent No.: US 6,334,346 B1
(45) Date of Patent: Jan. 1, 2002

(54) NUMERAL LOCK WITH RESETTABLE FEATURE

(76) Inventor: Song-Ming Wang, No. 24, Lane 49, Fu Hua 8th Street, Yung Kang City, Tainan Hsien (TW)

( * ) Notice: Subject to any disclaimer, the term of this patent is extended or adjusted under 35 U.S.C. 154(b) by 0 days.

(21) Appl. No.: 09/433,342

(22) Filed: Nov. 4, 1999

(51) Int. Cl.[7] ..... E05B 13/00; E05B 37/16

(52) U.S. Cl. ..... 70/214; 70/298; 70/299; 70/327

(58) Field of Search ..... 70/214, 327, 297–300, 70/287–290

(56) References Cited

U.S. PATENT DOCUMENTS

| | | | | | |
|---|---|---|---|---|---|
| 472,868 | A | * | 4/1892 | Féret | 70/298 |
| 1,092,733 | A | * | 4/1914 | McCarthy | 70/214 |
| 2,920,473 | A | * | 1/1960 | Hansen | 70/214 X |
| 3,009,346 | A | * | 11/1961 | Check | 70/214 |
| 3,680,336 | A | * | 8/1972 | Schendel | 70/298 X |
| 4,191,035 | A | * | 3/1980 | Hatch | 70/298 |
| 4,640,110 | A | * | 2/1987 | Fish et al. | 70/214 X |
| 4,827,743 | A | * | 5/1989 | Kim | 70/214 |
| 4,936,894 | A | * | 6/1990 | Larson et al. | 70/298 |

FOREIGN PATENT DOCUMENTS

| | | | | |
|---|---|---|---|---|
| FR | 2530717 | * | 1/1984 | 70/288 |
| GB | 9268 | * | 6/1889 | 70/298 |

* cited by examiner

*Primary Examiner*—Lloyd A. Gall
(74) *Attorney, Agent, or Firm*—Rosenberg, Klein & Lee

(57) ABSTRACT

A numeral lock with a resettable feature comprises an engaging plate separably engaging a plurality of locking pins. The locking pins each have a first engaging protrusion, which will block the engaging plate from moving for the lock to be locked. When facing in a first direction, such first engaging protrusions have to be separated from the engaging plate by depressing related locking pins for the numeral lock to be unlocked. The locking pins each connects to a respective one of a plurality of shaped holes of a sliding plate. The shape holes each has a circular hole portion and an elongated hole portion. The locking pins can be rotated when passing through the circular hole portions, and cannot be rotated when passing through the elongated hole portions. The sliding plate is moved so that the locking pins pass through either the circular hole portions or the elongated hole portions thereof. When the locking pins pass through the circular hole portions, the user can rotate the locking pins to change the direction of the first engaging protrusions, to reset the lock with a new pin number.

7 Claims, 7 Drawing Sheets

NUMERAL LOCK WITH RESETTABLE FEATURE

BACKGROUND OF THE INVENTION

The present invention relates to a numeral lock for a door, and the like, and particularly to a numeral lock mechanism, which has pin number capable of being changed according to a user's demand.

One of the purposes to use a numeral lock is to lock and unlock the door lock without having to use a key, eliminating the risk of losing the key after locking the lock.

One kind of popular numeral lock has several push buttons, each of which has a corresponding numeral. When the correct ones of the push buttons are depressed by the user, i.e. the corresponding numerals of the depressed push buttons are the same as the preset pin number, the door lock can be unlocked.

Furthermore, one main purpose of devising a numeral lock with resettable feature is to prevent a thief to become aware of the pin number by means of observing the push buttons to tell the correct ones from other irrelevant to the pin number; because the correct push buttons are constantly depressed by a user's finger, and thus have more polished surface than the irrelevant ones. Therefore, it is very important to develop a kind of numeral lock with resettable feature to overcome the above said disadvantages and to provide homes and offices with more security.

Referring to FIG. 10, a numeral lock with resettable feature is devised by the inventor of the present invention prior to the present invention; the prior art numeral lock comprises a housing 10, a plurality of locking pins 20, a confining plate 30, an engaging plate 40, a locating plate 50, and a bottom plate 60 as the main parts; the housing 10 has holes each receiving a push button connected to a respective one of the locking pins 20 for the locking pins 20 to be capable of being depressed by a user's fingers; each of the locking pins 20 has a first engaging protrusion 201 and a second engaging protrusion 202 arranged in opposite direction; the engaging plate 40 has locking holes 401 receiving the first engaging protrusions 201 of the locking pins 20; each locking hole 401 has an engaging portion 402 as shown in FIG. 11. The confining plate 30 is fixed to the housing 10 and has holes for receiving the second engaging protrusions 202 of the locking pins 20. The locating plate 50 and the engaging plate 40 are movably received within the housing 10. Both the locating plate 50 and the bottom plate 60 have holes for other ends of the locking pins 20 to be passed through, and into, respectively. When the first engaging protrusions 201' of the locking pins 20' face inwardly of the housing 10, they will engage the engaging portions 402 of the locking holes 401 of the engaging plate 40 and thus stop the engaging plate 40 from moving. Locking pins 20' of such inward facing first engaging protrusions 201' have to be depressed in order to separate such protrusions 201' from the locking holes 401 for the corresponding second protrusions 202' to be moved into the locking holes 401; such second protrusions 202', facing outward, will not stop the engaging plate 40 from moving.

When the engaging plate 40 is not stopped from moving by any of the engaging protrusions 201,202, i.e. the correct locking pins 20 are depressed, a handle associated with the engaging plate is capable of being turned to open the door.

A user can turn the locking pins 20 to change the direction of the protrusions 201 according to his predetermined pin number from top turning slots (not numbered)of the locking pins 20 with a screwdriver.

The above mentioned numeral lock is fixed to a door with bottom plate 60 contacting the door so the numeral lock has to be first removed from the door for permitting the locking pins 20 to be turned through the holes of the bottom plate 60, making the resettable process very inconvenient.

So, it is a main object of the present invention to devise a numeral lock that can be reset more easily and conveniently, not having to remove the entire lock from the door.

SUMMARY

A numeral lock with resettable feature of the present invention has lock pins each associated with a respective press button, the press buttons being arranged on a housing for a user to press to unlock the numeral lock. The locking pins each has a first and a second engaging protrusion opposing each other; the first engaging protrusions are received with locking holes of an engaging plate, and will engage the locking holes to stop engaging plate from moving when facing inwardly of the housing. Locking pins having such inwardly facing engaging protrusions have to be depressed for such protrusions to separate from the locking holes in order to unlock the lock.

The locking pins are associated with the press buttons such that they can turn along with the press buttons for permitting a user to reset the numeral lock with a new pin number. The corresponding numerals of those locking pins having inwardly facing first engaging protrusions constitute the pin number.

Furthermore, to simplify the resetting procedure of the numeral lock, a sliding plate is provided; the sliding plate has shaped holes each connected to a respective one of the locking pins. The shaped holes each has a round hole portion and a rectangular hole portion; when the sliding plate is moved such that the round hole portions thereof connect the locking pins, the locking pins are capable of turning for permitting a user to rest the numeral lock; on the other hand, when the rectangular hole portions connect the locking pins, the lockings are incapable of turning, preventing the locking pins from being unwarily turned. The sliding plate is further protected from being unwarily moved by a box shape cover capable of being locked up by another lock device.

Thus, it can be understood that the numeral lock of the present invention can be reset very easily.

BRIEF DESCRIPTION OF THE DRAWINGS

The present invention will be better understood with reference to the accompanying drawings, wherein.

DETAILED DESCRIPTION OF THE PREFERRED EMBODIMENTS

Figure 1:
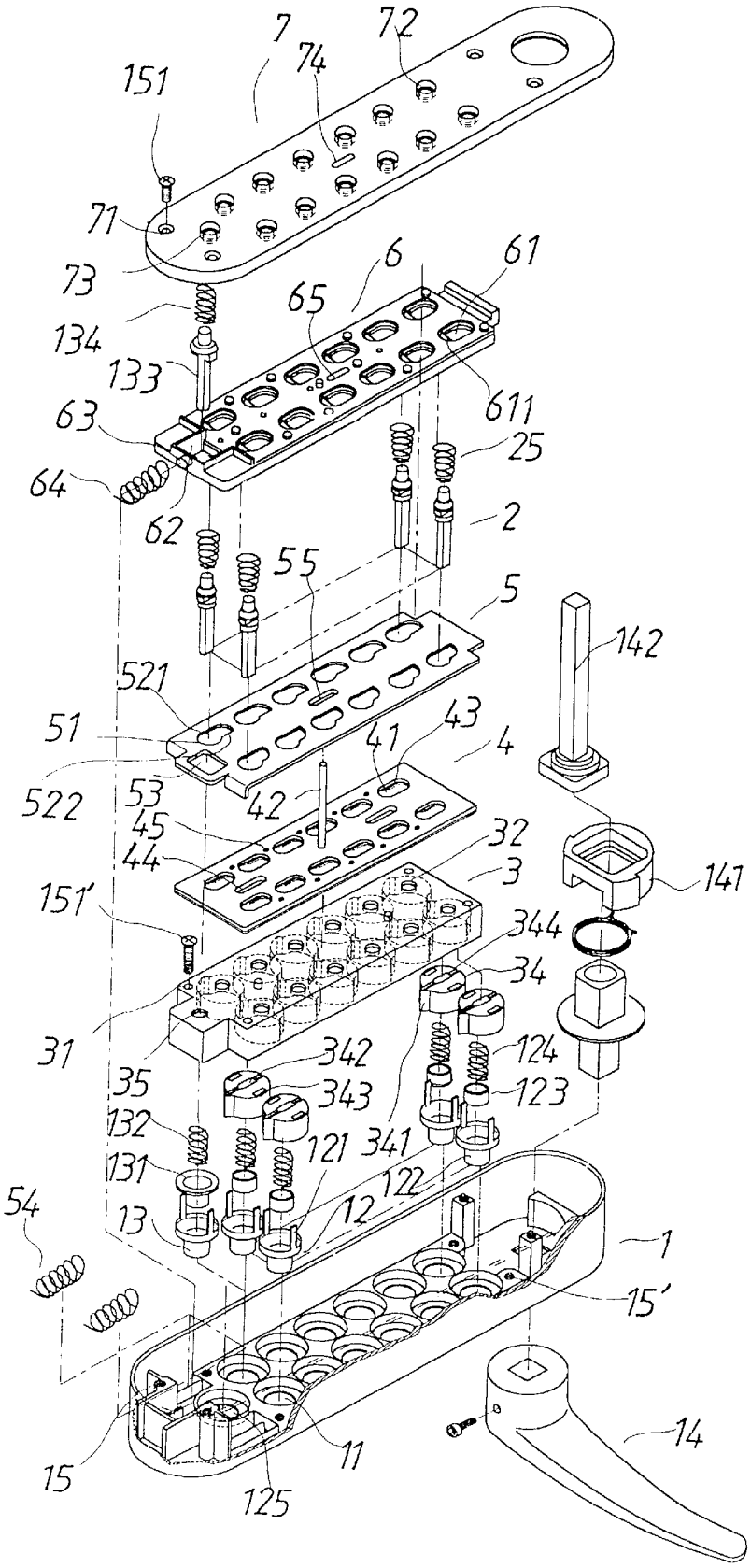
FIG. 1 is an exploded perspective view of a numeral lock of the present invention.
Figure 2:
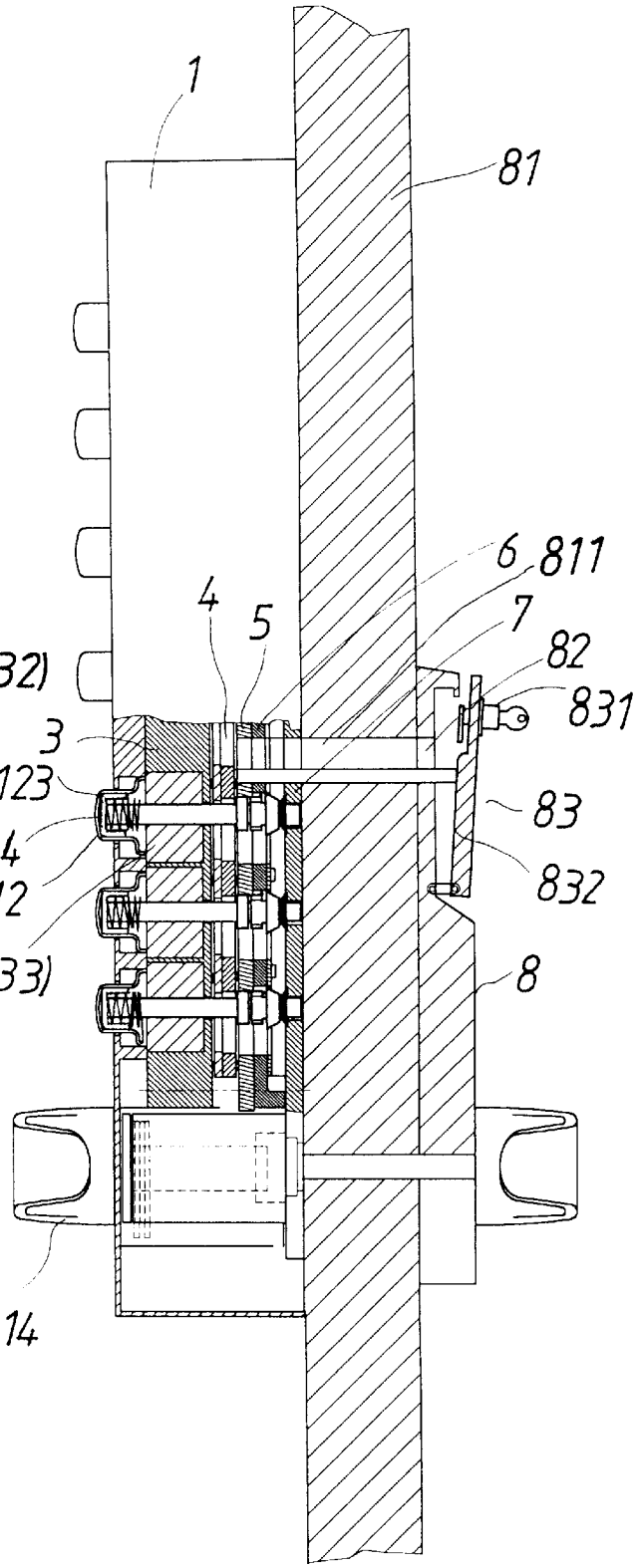
FIG. 2 is a sectional view of a numeral lock of the present invention with locking pins thereof being stopped from turning by the sliding plate.

A numeral lock of the present invention, referring to FIGS. 1 and 2, comprises a housing 1, a plurality of locking pins 2, a confining plate 3, a sliding plate 4, an engaging plate 5, a locating plate 6, and a bottom plate 7 as the main parts; the numeral lock is fitted to a door and is associated with a connecting plate 8 disposed on inner side of the door as shown in FIG. 2.

The housing 1 has round holes 11 on one side for receiving round press buttons 12 therein, and has screw holes 15 and a recovering button hole 125 for receiving a recovering button 13 therein; the recovering button 13 is associated with a cushion 131, a spring 132, and a recovering rod 133 passed through the confining plate 3.

Figure 5:
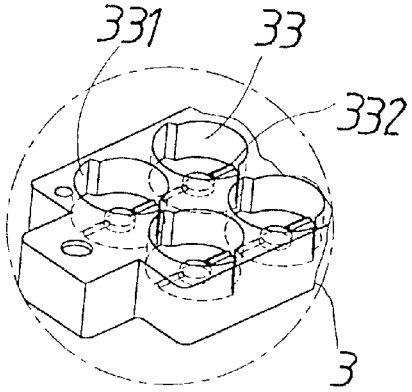
FIG. 5 is a fragmentary perspective view of a confining plate of the present invention viewed from other side.
Figure 4:
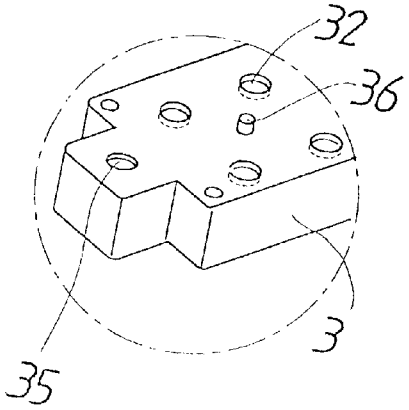
FIG. 4 is a fragmentary perspective view of a confining plate of the present invention.

The confining plate 3 is fixed to the housing 1 by screws 151' passed into the screw holes 15' of the housing 1 and through holes 31 thereof. Referring to FIGS. 4 and 5, the confining plate 3 further has a guiding projection 36 and confining recesses 33 facing the round holes 11 of the housing 1; each confining recess 33 has a central hole 32, two radially arranged opposing locating convex portions 332 and a confining portion 331. The confining portion 331 is a semicircle recess of each of the confining recess 33.

Each confining recess 33 houses a locating member 34 therein; the locating members 34 are capable of turning inside the confining recesses 33, and each has a stopping projecting portion 341, an elongated connecting hole 342, two holding holes 343 and two radially disposed opposing locating trenches 344; each locating member 34 is connected to a respective one of the press buttons 12 with a respective springs 132 disposed in between, and with side projections 121 of the press buttons 12 passed into the holding holes 343 of the locating members 34; thus, the locating members 34 can be turned along with the press buttons 12. The stopping projecting portions 341 of the locating members 34 are each movably disposed within a respective one of the confining portions 331 of the confining recesses 33 of the confining plate 3 such that the locating members 34 can only be turned for one hundred and eighty degrees. The connecting holes 342 of the locating members 34 are substantially rectangular. The locating trenches 344 of the locating members 34 can separably engage the locating convex portions 332 of the confining recesses 33 of the confining plate 3 when the locating members 34 are being turned.

Figure 7:
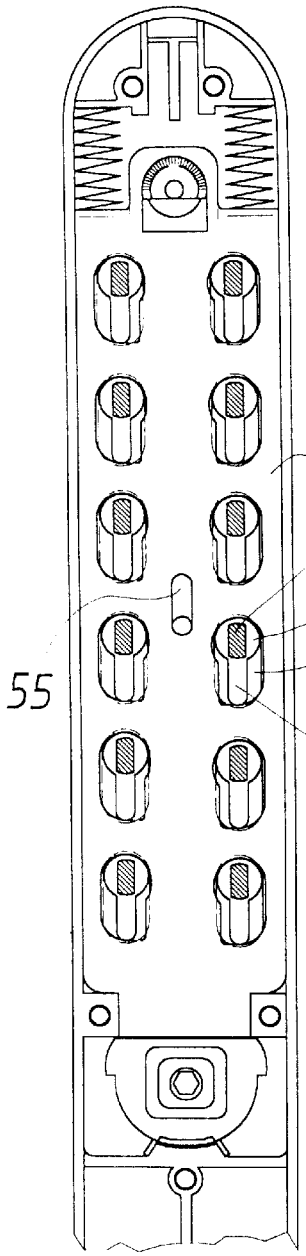
FIG. 7 is a view showing the numeral lock of the present invention with locking pins thereof being capable of turning relative to holes of the sliding plate.
Figure 6:
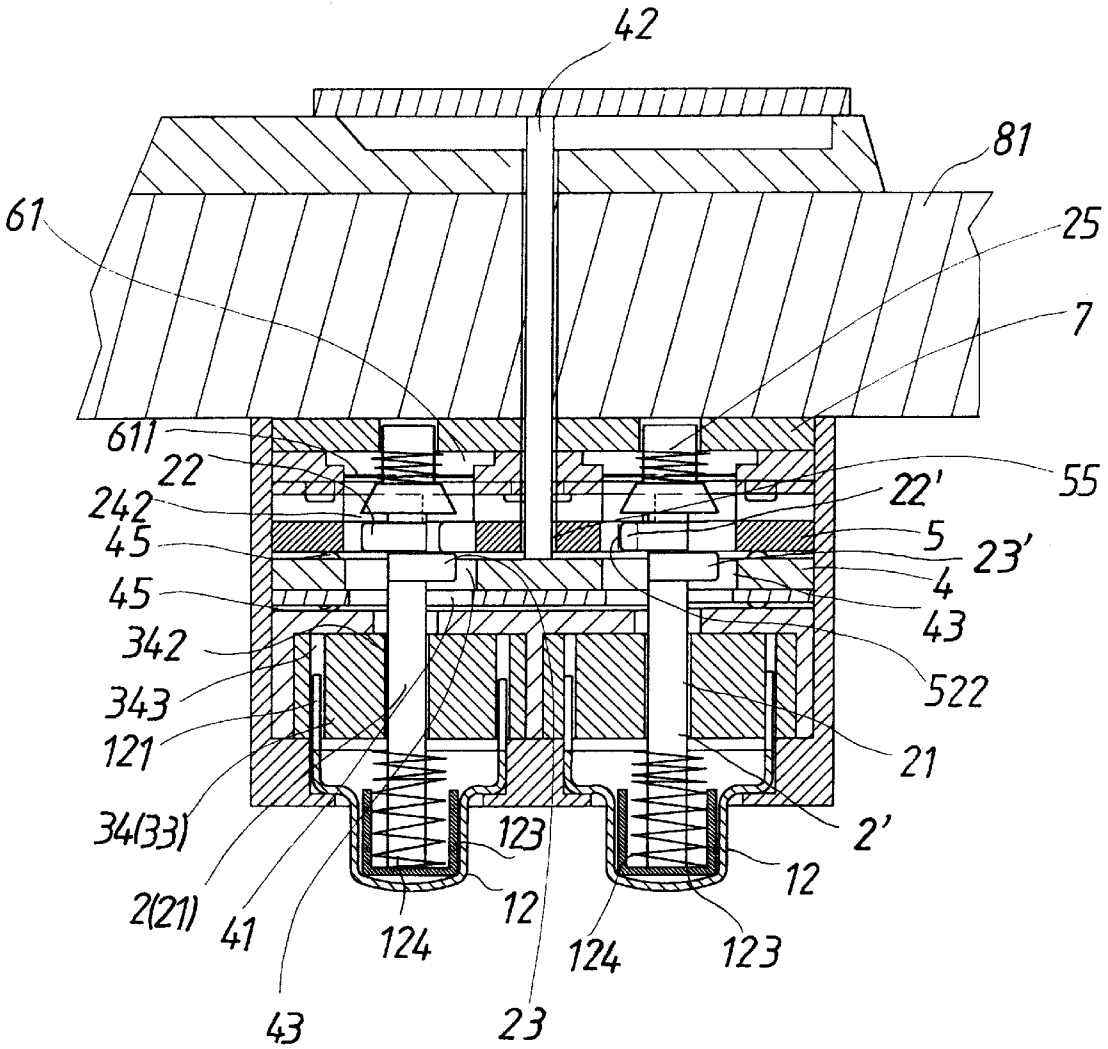
FIG. 6 is a cross-sectional view of a numeral lock of the present invention.
Figure 9:
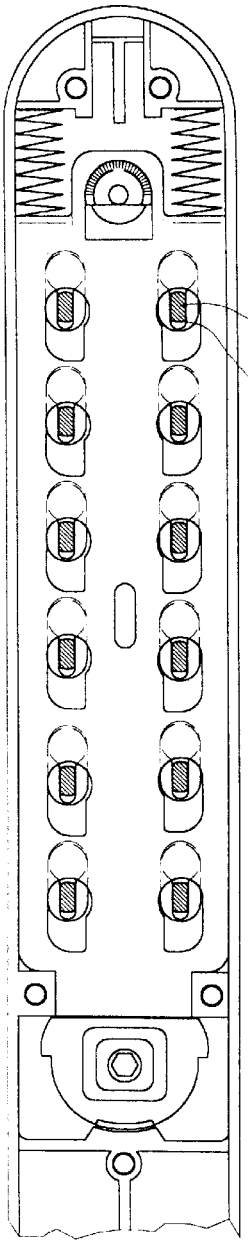
FIG. 9 is a view showing the numeral lock of the present invention with locking pins thereof being connected with round hole portions of sliding plate, and capable of turning.
Figure 8:
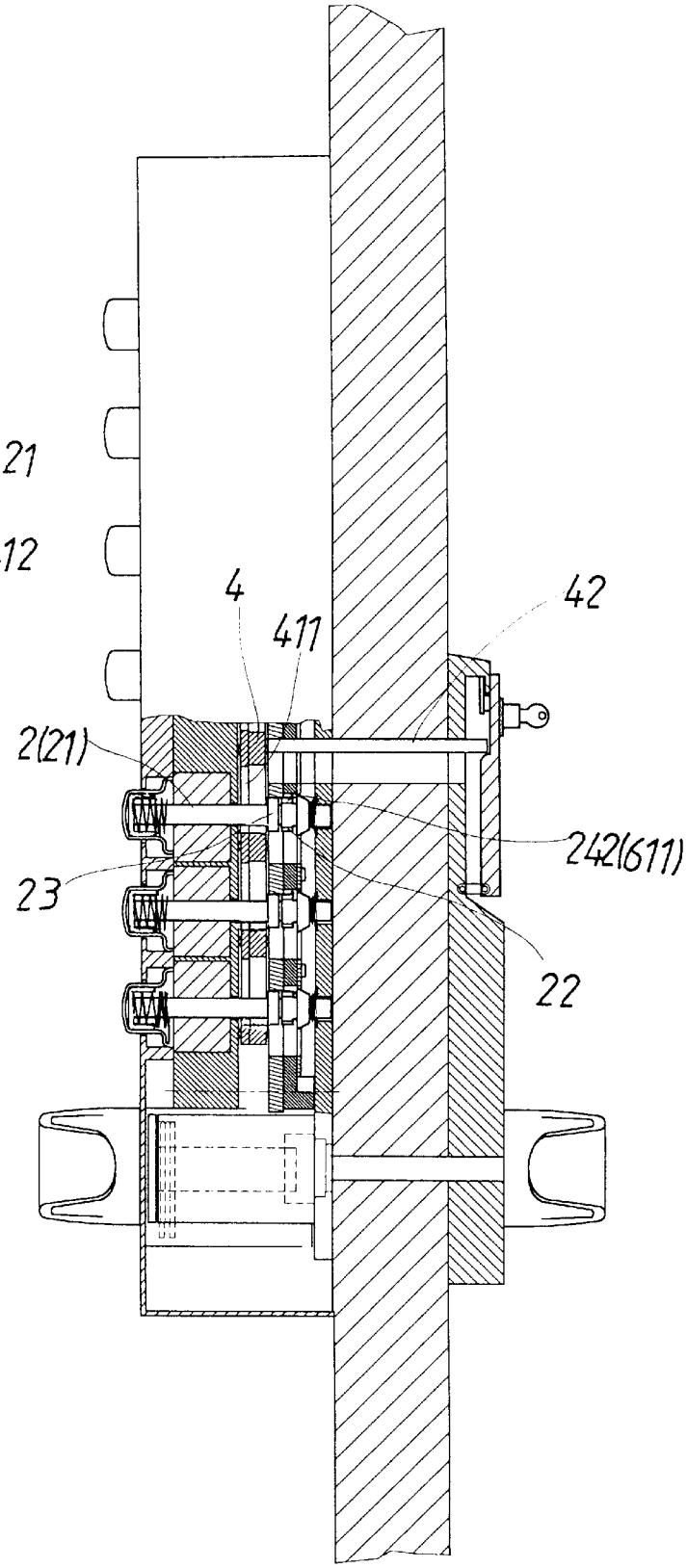
FIG. 8 is sectional view of a numeral lock of the present invention with locking pins thereof being received within rectangular hole portions of the sliding plate.
Figure 10:
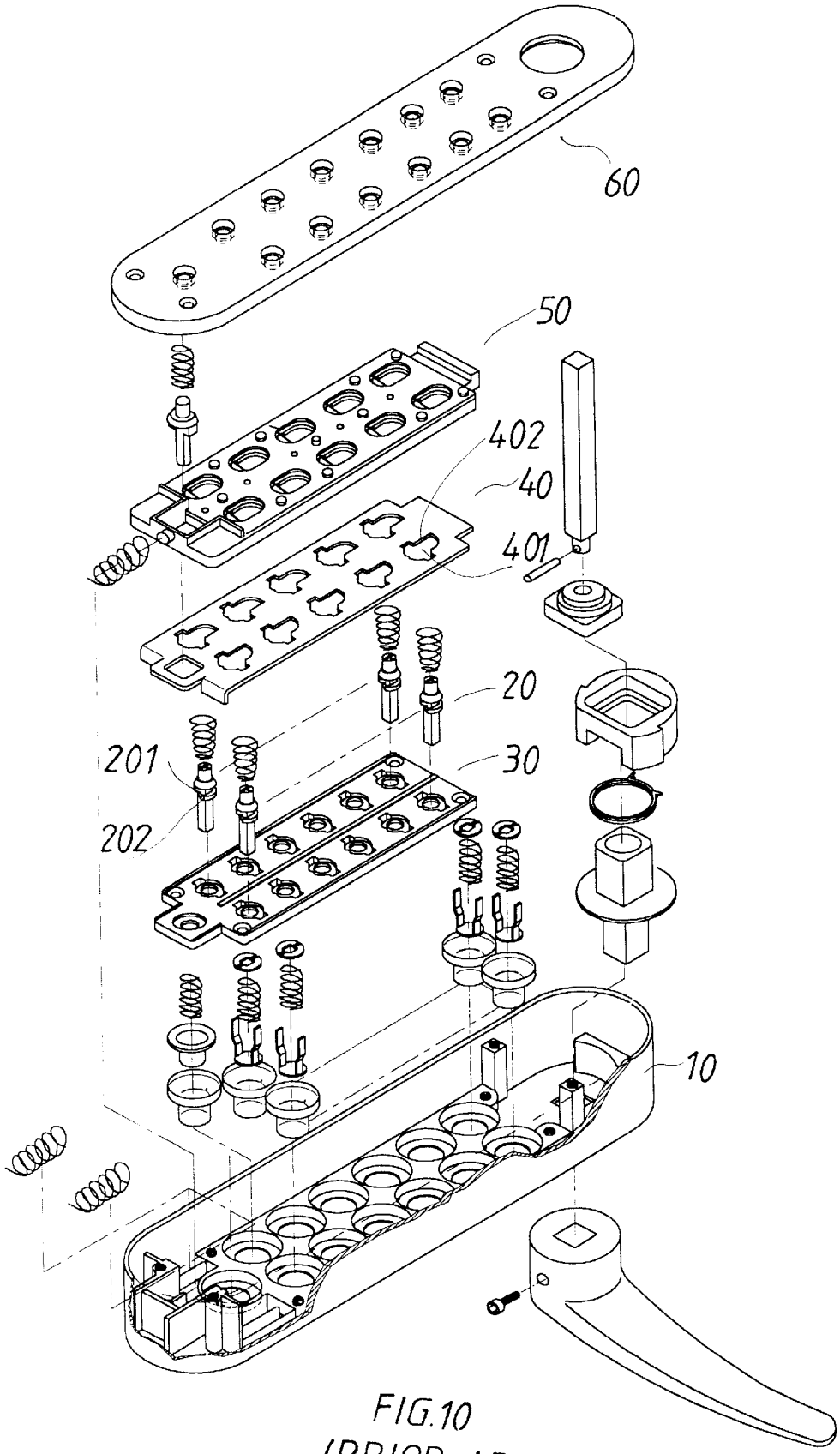
FIG.10 (PRIOR ART)
FIG. 10 is an exploded perspective view of a prior art numeral lock as mentioned in the Background; and, FIG. 11 is a sectional view of the prior art numeral lock with a locking pin thereof being depressed.
Figure 11:
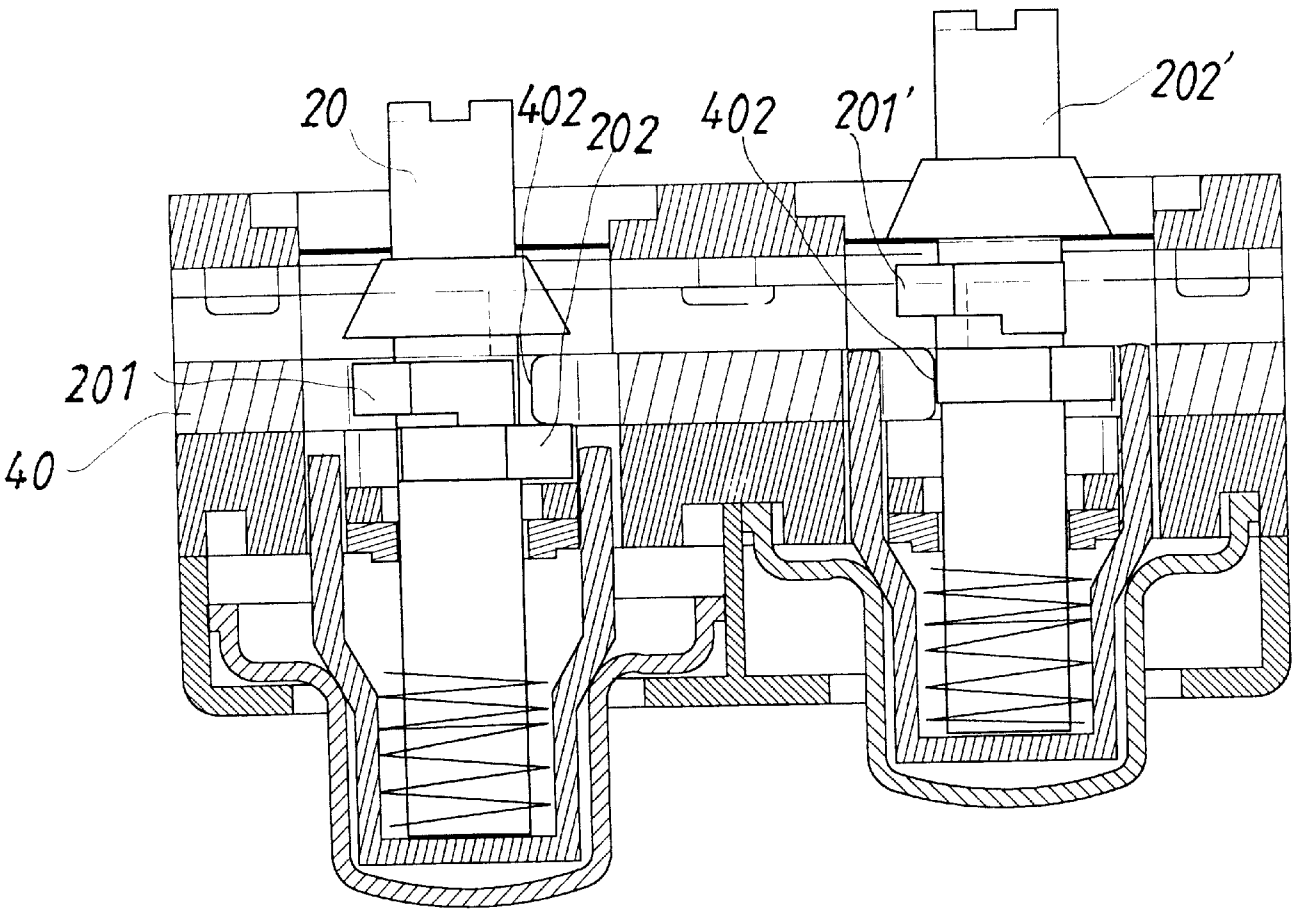
FIG.11 (PRIOR ART)

The sliding plate 4 is movably disposed within the housing 1 next to the confining plate 3, and has a guiding slot 44, a pushing rod 42 and shaped holes 41. Each shaped hole 41 consists of a circular hole portion 411 and a narrower elongated hole portion 412 extending from the circular hole portion 411 as shown in FIG. 7. Referring to FIGS. 1, 6 and 7, the sliding plate 4 further has receiving holes 43 thereon, coaxial with the shaped holes 41; the receiving hole 43 are substantially elongated holes. The guiding projection 36 of the confining plate 3 is received with the guiding slot 44 of the sliding plate 4 such that the sliding plate 4 can slide along a desired path defined by the guiding slot 44 thereof. Furthermore, the sliding plate 4 has convex projections 45 on two sides thereof such that friction between the same and the confining plate 3 and between the same and the engaging plate 5, which is disposed next to the sliding plate 4 as shown in FIG. 1, is reduced for the sliding plate 4 to easily slide therebetween.

The engaging plate 5 is movably disposed within the housing 1, next to the sliding plate 4, and is biased by springs 54 disposed between upper end thereof and inner wall of the housing 1. The engaging plate 5 has a recovering rod hole 53, an elongated hole 55, and locking holes 51 each corresponding to a respective one of the receiving holes 43 of the sliding plate 4. Each of the locking holes 51 consists of a substantially circular passing portion 521 at one side, and an engaging portion 522 at the other side. The engaging portions 522 are each shaped like a step.

A recovering rod 133 is passed through the recovering rod hole 53 of the engaging plate, the through hole 35 of the confining plate 3, and the spring 132, and is received within the cushion 131 associated with the recovering button 13 at one end.

Figure 3:
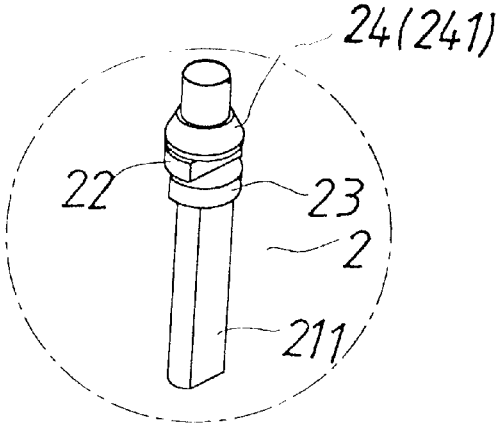
FIG. 3 is a perspective view of a locking pin of the present invention.

Referring to FIG. 3, the locking pins 2 each has a connecting rod portion 21, a first engaging protrusion 22, a second engaging protrusion 23, a locating rim 24 and an engaging trench 242, shown in FIG. 6, between the first engaging protrusion 22 and the locating rim 24. The connecting rod portions 21 have flat surfaces 211 on two sides thereof. Each first engaging protrusion 22 has a semicircular shape and is arranged in a direction opposite to the respective second engaging protrusion 23 also having a semicircular shape. The locating rims 24 each has a slope 241.

The locking pins 2 are each passed through a respective one of the locking holes 51 of the engaging plate 5, and the respective shaped hole 41, the respective central hole 32, and the respective connecting hole 342 of the locating members 34, and received within the respective press button 12 at one end; each of the first engaging protrusions 22 is held within the respective locking hole 51; each of the second engaging protrusions 23 is received within the respective receiving hole 43 on the sliding plate; the connecting rod portions 21 are capable of turning within the round hole portions 411 of the shaped holes 41 of the sliding plate 4 but are stopped from turning when engaging the rectangular hole portion 412 of the shaped holes 41; furthermore, the connecting rod portions 21 of the locking pins 2 are by no means capable of turning relative to the connecting holes 342 of the locating members 34 such that the locking pins 2 can turn along with the corresponding press buttons 12.

The locating plate 6 is movably disposed within the housing 1, next to the engaging plate 5, and is biased by a spring 64 disposed between inner wall of the housing 1 and an upper end thereof. A projecting portion 63 is provided at the upper end of the locating plate to confine the spring 64 as shown in FIG. 1. The locating plate 6 further has through hole 62, an elongated hole 65, and locating holes 61 each corresponding to a respective one of the locking holes 51 of the engaging plate 5. The through hole 62 has a contour adapted for contacting a sloped rim (not numbered) of the recovering rod 133 such that the locating plate 6 can be pushed when the recovering rod 133 is depressed. Each locating hole 61, at an end toward the spring 64, is provided with an elastic string 611 movable at the end of the respective locating hole 61. Each of the locking pins 2 is passed through a respective one of the locating holes 61 of the locating plate 6, with the respective elastic string 611 disposed on the slope 241 of the locating rim 24 thereof. The pushing rod 42 of the sliding plate 4 is passed through the elongated hole 65.

The bottom plate 7 is fixed to the housing 1, next to the locating plate 6, by screws 151 passed through holes 71 thereof, and has a through hole 73, through holes 72 and an elongated hole 74. The other ends of the locking pins 2 are each passed into a respective one of the through holes 72 of the bottom plate 7 with a spring 25 disposed between the respective locating rim 24 and the respective through hole 72 for the locking pins 2 to be biased toward the press buttons 12. The other end of the recovering rod 133 is passed into the through hole 73 of the bottom plate 7 with a spring 134 disposed between the sloped rim of the recovering rod 133 and the through hole 73 to bias the recovering rod toward the recovering button 13. The pushing rod 42 of the sliding plate 4 is passed through the elongated hole 74 thereof.

The numeral lock is operationally associated with a press handle 14 which is coupled to a turning member 141 that is disposed within the housing 1, adjacent to the lower end of the engaging plate 5 and lower end of the locating plate 6. The handle 14 and an activating rod 142 are connected to the turning member 141 such that the handle 14, the turning member 141, and the activating rod 142 can turn together. The activating rod 142 is further connected to a dead bolt (not shown) provided for locking a door. Referring to FIG. 2, the numeral lock is fitted to the outer side of a door 81 and combined with the connecting plate 8 fitted to the inner side of the door 81. The pushing rod 42 is passed through an elongated hole 811 of the door 81 and an elongated hole 82 of the connecting plate 8. A box shaped cover 83 is pivoted to the connecting plate 8 at one end of the cover 83 and is provided with a lock 831 for fastening the box shape cover 83 onto the connecting plate 8. Furthermore, a convex portion 832 is provided on the inner side of the cover 83 such that the cover 83 will not be able to be fastened onto the connected plate 8 unless the pushing rod 42 is pushed back to its original position after use. Thus, the user can easily know whether the sliding plate 4 is in a desired position.

In assembling the numeral lock of the present invention, all of the first engaging protrusions 22 of the locking pins 2 are first arranged to face in a first direction such that in this position, the first engaging protrusions 22 are adjacent to the circular passing portions 521 of the locking holes 51, and so do not stop the engaging plate 5 from moving.

In setting a predetermined pin number, referring to FIGS. 2, 6 and 7, we have to open the box shaped cover 83, and push the pushing rod 42 to move the sliding plate 4 to displace the connecting rod portions 21 of the locking pins 2 to be received within the circular hole portions 411 of the sliding plate 4. Then, we turn those of the press buttons 12 which have corresponding numerals included in the predetermined pin number through one hundred and eighty degrees, the stopping projecting portions 341 of the locating members 34 moving from one end of the confining portions 331 of the confining plate 33 to the other. Thus, such rotated press buttons 12 will make the corresponding locking pins 2 turn, and consequently, such turned locking pins 2', as shown in FIG. 6, have first engaging protrusions 22' facing in a second direction, opposite the first direction. Under this condition, the first engaging protrusions 22' facing the second direction engage the corresponding engaging portions 522 of the locking holes 51 in the engaging plate 5 to prevent the engaging plate 5 from moving. Then, the sliding plate 4 is moved to its original position for the connecting rod portions 21 of the locking pins 2 to be received within the elongated hole portions 412 of the sliding plate 4, so that the locking pins 2 cannot be rotated. Next, the box shape cover 83 is fastened onto the connecting plate 8 with the locking device 831, so that the pin number will not be inadvertently changed.

Because the first engaging protrusions 22' engage the engaging portions 522 of the locking holes 51 in the engaging plate 5, the engaging plate 5 cannot be moved, and stops the turning member 141 associated therewith from turning. Thus, the handle 14 cannot be turned to open the door, i.e. the door is locked.

To unlock the numeral lock, we have to depress the press buttons 12 corresponding to the pin number such that the rotated locking pins 2' are depressed, and the above first engaging protrusions 22' separate from the related engaging portions 522 of the engaging plate 5. Thus, the engaging plate 5 is no longer blocked from moving by the first engaging protrusions 22'. The corresponding second engaging protrusions 23', as shown in FIG. 6, are now received within circular passing portions 521 of the locking holes 51 in the engaging plate 5, and will not block the engaging plate 5 from moving. Furthermore, the depressed lock pins 2' will not move back to their respective original positions because the engaging trenches 242 of the depressed locking pins 2' engage the elastic strings 611 of the locating plate 6 when the locking pins 2' are depressed. When the handle 14 is rotated to open the door, the locating plate 6 is moved by the turning member 141 associated therewith, and the elastic strings 611 separate from the engaging trenches 242 of the depressed locking pins 2', permitting the locking pins 2' to be respectively moved to their original position by the springs 25.

On the other hand, when wrong locking pins 2 are depressed, we only have to depress the recovering button 13 such that the recovering rod 133 will displace the locating plate 6 to permit the elastic strings 611 of the locating plate to separate from engaging trenches 242 of such wrongly depressed locking pins 2. Thus, the springs 25 are then able to push those locking pins 2 back to their respective original positions.

To reset the numeral lock, we only have to open the box shape cover 83 and move the sliding plate 4 as described above, and then the press buttons 12 corresponding to a new pin number are rotated.

From the above description, it can be understood that the numeral lock of the present invention has an advantage that the numeral lock can be reset without need of removing the same from the door, greatly increasing convenience in using the lock.

What is claimed is:

1. A numeral lock with a resettable feature, comprising (a) a housing having a plurality of round holes each receiving a respective press button;

(b) a confining plate fixed to said housing, and having a plurality of confining recesses formed therein, said confining plate having a plurality of holes formed therein, each of said plurality of holes being centrally disposed with respect to a respective one of said plurality of confining recesses;

(c) a plurality of locating members respectively received in said confining recesses, said locating members each having an elongated connecting hole, and being connected to a respective one of said press buttons, said locating members each being rotatable within a respective one of said confining recesses in correspondence with a respective press button;

(d) a sliding plate movably disposed next to said confining plate within said housing, and having a first side with a plurality of shaped holes formed therein each corresponding to a respective one of said plurality of holes of said confining plate, said sliding plate further having a pushing rod projecting from a second side thereof, said second side of said sliding plate having a plurality of receiving holes formed therein, said shaped holes each having a circular hole portion, and an elongated hole portion extending from said circular hole portion and being narrower than said circular hole portion;

(e) an engaging plate movably disposed adjacent to said sliding plate within said housing, and having a plurality of locking holes each corresponding to a respective one of said receiving holes of said sliding plate, said locking holes each having a circular passing portion, and an engaging portion adjacent each other, said engaging plate being biased toward a lower end of said housing by a spring connected to an end of said engaging plate, said engaging plate further having an elongated hole formed therethrough for said pushing rod of said sliding plate to pass therethrough;

(f) a plurality of locking pins each passed through a respective one of said locking holes of said engaging plate, and into a respective one of said press buttons, said locking pins each having a connecting rod portion, a first engaging protrusion, a second engaging protrusion, a locating rim, and an engaging trench formed between said first engaging protrusion and said locating rim, said first and second engaging protrusions having semicircular shape and being arranged in opposite directions; said connecting rod portions being each passed into a respective connecting hole of a corresponding one of said locating members for permitting said locking pins to be rotated with said locating members and press buttons, said second engaging protrusions each being received within a respective one of said receiving holes of said sliding plate, said first engaging protrusions being each received within a respective one of said locking holes of said engaging plate;

(g) a locating plate movably disposed adjacent to said engaging plate within said housing, said locating plate being biased toward said lower end of said housing by a spring connected to an end of said locating plate, said locating plate further having a plurality of locating holes each corresponding to a respective one of said locking pins, and each having an elastic string disposed therein, said locating plate having an elongated hole formed therethrough for said pushing rod of said sliding plate to pass therethrough;

(h) a bottom plate fixed to said housing adjacent to said locating plate, said bottom plate having (a) a plurality of through holes each receiving an end portion of a respective one of said locking pins, and (b) an elongated hole formed therethrough for said pushing rod to pass therethrough, said locking pins each being spring biased toward a respective of said press buttons; and, (i) a connecting plate fixed to an inner side of a door and connected to said housing fitted to an outer side of said door;

said sliding plate being displaceable to locate said circular hole portions thereof for said connecting rod portions of said locking pins to pass therethrough, said locking pins being rotatable within said circular hole portions of said sliding plate and non-rotatable within said elongated hole portions of said sliding plate, said locking pins being rotatable to orient said first engaging protrusions in one of a first direction and an opposing second direction, said first engaging protrusions of said locking pins engaging respective locking holes of said engaging plate when facing said second direction to block said engaging plate from moving, in said second direction said locking pins being depressable with said press buttons for said first engaging protrusions to separate from the respective locking holes and said engaging plate to be moved, in said first direction said first engaging protrusions being free of engagement with said locking holes and said engaging plate being free to move;

said engaging trenches of corresponding locking pins being engaged with said respective elastic strings responsive to said corresponding locking pins being depressed for preventing said depressed locking pins from returning to an original position; and said engaging plate being associated with a turning member disposed within said housing, said turning member being connected to a handle and being rotatable therewith, said handle and said turning member being blocked from rotation and opening said door when said engaging plate being blocked from moving by first engaging protrusions of said locking pins.

2. A numeral lock with a resettable feature as claimed in claim 1, wherein said pushing rod is passed through said door, and said connecting plate, and protected with a box shaped cover pivoted to said connecting plate; said box shaped cover having a lock device for fastening to said connecting plate, and having a convex portion on an inner side thereof; said convex portion contacting said pushing rod to block said box shaped cover from closing on said connecting plate when said pushing rod has moved said sliding plate to a position where said connecting rod portions of said locking pins extend through said circular hole portions of said shaped holes of said sliding plate.

3. A numeral lock with a resettable feature as claimed in claim 1, wherein said locating members each have at least one stopping projecting portion extending therefrom, said confining recesses of said confining plate each has a confining portion forming a semicircular recess for receiving a respective stopping projecting portion of a respective one of said locating members to confine rotational movement of said locating members within said semicircular confining portions.

4. A numeral lock with a resettable feature as claimed in claim 1, wherein each of said press buttons has two side projections passing into two holding holes of a respective locating member.

5. A numeral lock with a resettable feature as claimed in claim 1, wherein said sliding plate has convex projections on each of two sides thereof.

6. A numeral lock with a resettable feature as claimed in claim 1, wherein a recovering rod is connected to said locating plate and is depressed with depression of a recovering press button of said housing, depression of said recovering rod displacing said locating plate.

7. A numeral lock with a resettable feature as claimed in claim 1, wherein said confining plate has a guiding projection received within a guiding slot of said sliding plate to confine a moving path of said sliding plate.

* * * * *